US011034038B2

(12) United States Patent
Chang et al.

(10) Patent No.: US 11,034,038 B2
(45) Date of Patent: Jun. 15, 2021

(54) RAZOR HANDLE ASSEMBLY AND RAZOR COMPRISING THE SAME

(71) Applicant: DORCO CO,. LTD., Seoul (KR)

(72) Inventors: Jun Soo Chang, Seoul (KR); Kyong Sik Lee, Seoul (KR); Nam Yoon Kong, Seoul (KR); Woo Gyeong Go, Seoul (KR)

(73) Assignee: DORCO CO., LTD., Seoul (KR)

( * ) Notice: Subject to any disclaimer, the term of this patent is extended or adjusted under 35 U.S.C. 154(b) by 63 days.

(21) Appl. No.: 15/983,703

(22) Filed: May 18, 2018

(65) Prior Publication Data

US 2018/0264667 A1 Sep. 20, 2018

Related U.S. Application Data

(63) Continuation of application No. PCT/KR2015/012530, filed on Nov. 20, 2015.

(30) Foreign Application Priority Data

Nov. 20, 2015 (KR) ..... 10-2015-0163090

(51) Int. Cl.
*B26B 21/52* (2006.01)
*B26B 21/14* (2006.01)
(Continued)

(52) U.S. Cl.
CPC ..... *B26B 21/521* (2013.01); *B26B 21/08* (2013.01); *B26B 21/14* (2013.01); *B26B 21/225* (2013.01); *B26B 21/52* (2013.01); *B26B 21/522* (2013.01)

(58) Field of Classification Search
CPC ..... B26B 21/08; B26B 21/14; B26B 21/225; B26B 21/52; B26B 21/521; B26B 21/522;
(Continued)

(56) References Cited

U.S. PATENT DOCUMENTS 4,253,236 A * 3/1981 Jacobson ..... B26B 21/521 30/47
4,288,920 A * 9/1981 Douglass ..... B26B 21/521 30/47
(Continued)

FOREIGN PATENT DOCUMENTS

EP 1115537 7/2001
JP 2004-313801 A 11/2004
(Continued)

OTHER PUBLICATIONS

European Patent Office Application Serial No. 15908859.0, Search Report dated Apr. 12, 2019, 7 pages.
(Continued)

*Primary Examiner* — Jason Daniel Prone
(74) *Attorney, Agent, or Firm* — Lee, Hong, Degerman, Kang & Waimey

(57) ABSTRACT

A razor handle assembly includes a gripping part gripped by a user, and a connecting part provided at one end of the gripping part to fix the cartridge. The connecting part includes a cartridge holder to which the cartridge is detachably coupled, and a holder clip which supports the cartridge holder. The cartridge holder is coupled to surround the outer side of an end portion of the holder clip.

14 Claims, 7 Drawing Sheets

(51) Int. Cl.
*B26B 21/08* (2006.01)
*B26B 21/22* (2006.01)

(58) Field of Classification Search
CPC ..... B26B 21/16; B26B 21/165; B26B 21/22; B26B 21/40; B26B 21/4012; B26B 21/4062
USPC ..... 30/47–51, 526–536
See application file for complete search history.

(56) References Cited

U.S. PATENT DOCUMENTS 4,403,414 A * 9/1983 Kiraly ..... B26B 21/225 30/531
4,797,998 A * 1/1989 Motta ..... B26B 21/225 30/530
5,182,858 A * 2/1993 Chen ..... B26B 21/521 30/530
5,687,485 A 11/1997 Shurtleff et al.
5,761,814 A 6/1998 Anderson et al.
5,956,848 A 9/1999 Tseng et al.
5,956,851 A 9/1999 Apprille et al.
6,041,926 A 3/2000 Petricca et al.
6,052,903 A 4/2000 Metcalf et al.
6,161,287 A * 12/2000 Swanson ..... B26B 21/4018 30/50
6,185,822 B1 2/2001 Tseng et al.
6,212,777 B1 4/2001 Gilder et al.
6,381,857 B1 * 5/2002 Oldroyd ..... B26B 21/225 30/526
6,421,925 B1 * 7/2002 Wonderley ..... B26B 21/4062 30/532
6,425,184 B1 * 7/2002 Min ..... B26B 21/225 30/51
6,434,839 B1 * 8/2002 Lee ..... B26B 21/225 30/527
6,442,839 B1 9/2002 Tseng et al.
6,516,518 B1 2/2003 Garraway et al.
6,584,696 B2 * 7/2003 Ferraro ..... B26B 21/521 30/526
6,612,040 B2 9/2003 Gilder
6,684,513 B1 2/2004 Clipstone et al.
7,140,116 B2 * 11/2006 Coffin ..... B26B 21/225 30/531
7,681,320 B2 * 3/2010 Szczepanowski .... B26B 21/225 30/34.05
7,703,361 B2 * 4/2010 Johnson ..... B26B 21/44 83/13
8,205,344 B2 * 6/2012 Stevens ..... B26B 21/521 30/527
8,381,406 B2 * 2/2013 Miyazaki ..... B26B 21/227 30/51
8,590,162 B2 * 11/2013 Park ..... B26B 21/225 30/50
8,671,577 B2 * 3/2014 Brown ..... B26B 21/225 30/50
8,789,282 B2 * 7/2014 Wilson ..... B26B 21/521 30/74
D745,215 S * 12/2015 Go ..... D28/48
9,283,685 B2 * 3/2016 Griffin ..... B26B 21/521
D768,930 S * 10/2016 Kong ..... D28/48
9,475,202 B2 * 10/2016 Griffin ..... B26B 21/225
9,630,331 B2 * 4/2017 Griffin ..... B26B 21/225
D789,609 S * 6/2017 Kong ..... D28/48
9,757,870 B2 * 9/2017 Giannopoulos ..... B26B 21/14
9,902,077 B2 * 2/2018 Park ..... B26B 21/225
D824,102 S * 7/2018 Go ..... D28/48
D827,201 S * 8/2018 Go ..... D28/48
10,406,705 B2 * 9/2019 Liberatore ..... B26B 21/522
10,500,747 B2 * 12/2019 Tucker ..... B26B 21/4081
10,632,635 B2 * 4/2020 Kim, II ..... B26B 21/4012
2004/0025356 A1 * 2/2004 Gilder ..... B26B 21/4031 30/527
2004/0181953 A1 * 9/2004 Folio ..... B26B 21/225 30/527
2004/0181954 A1 * 9/2004 Folio ..... B26B 21/521 30/527
2006/0123631 A1 6/2006 Szczepanowski et al.
2006/0260131 A1 * 11/2006 Folio ..... B26B 21/52 30/50
2010/0043242 A1 * 2/2010 Stevens ..... B26B 21/521 30/527
2011/0088269 A1 * 4/2011 Walker, Jr. ..... B26B 21/225 30/527
2012/0124840 A1 * 5/2012 Iaccarino ..... B26B 21/225 30/50
2012/0279070 A1 * 11/2012 Seo ..... B26B 21/4012 30/34.2
2014/0116211 A1 * 5/2014 Griffin ..... B26B 21/225 30/47
2015/0266191 A1 9/2015 Maimone et al.
2015/0290819 A1 * 10/2015 Giannopoulos ..... B26B 21/225 30/532
2015/0306777 A1 * 10/2015 Georgakis ..... B26B 21/14 30/57
2015/0314466 A1 * 11/2015 Papadopoulos-Papageorgis ..... B26B 21/14 30/532
2015/0321366 A1 * 11/2015 Papadopoulos-Papageorgis ..... B26B 21/225 30/532
2016/0144520 A1 * 5/2016 Lee ..... B26B 21/14 30/51
2016/0158950 A1 * 6/2016 Griffin ..... B26B 21/521 30/532
2017/0080585 A1 * 3/2017 Griffin ..... B26B 21/225
2017/0341249 A1 * 11/2017 Lee ..... B26B 21/14
2018/0264665 A1 * 9/2018 Kim, II ..... B26B 21/22
2019/0152077 A1 * 5/2019 Kim ..... B26B 21/4012
2019/0152079 A1 * 5/2019 Chang ..... B26B 21/225
2019/0337174 A1 * 11/2019 Kopelas ..... B26B 21/521
2020/0009754 A1 * 1/2020 Provost ..... B26B 21/225
2020/0023532 A1 * 1/2020 Gratsias ..... B26B 21/522
2020/0039098 A1 * 2/2020 Kopelas ..... B26B 21/225
2020/0070376 A1 * 3/2020 Petratou ..... B26B 21/225
2020/0223080 A1 * 7/2020 Tucker ..... B26B 21/521
2020/0223081 A1 * 7/2020 Tucker ..... B26B 21/521

FOREIGN PATENT DOCUMENTS

JP 2009-542305 A 12/2009
KR 10-1988-0004911 A 6/1988
KR 20-0276579 Y1 5/2002
KR 10-2006-0127192 A 12/2006
KR 10-0903191 B1 6/2009
KR 10-2014-0069811 A 6/2014
KR 10-2015-0095935 A 8/2015
KR 10-2015-0099587 A 8/2015
WO WO-0016951 A1 * 3/2000 ..... B26B 21/40
WO 2008147133 12/2008
WO 2014094910 6/2014

OTHER PUBLICATIONS

International Search Report issued for corresponding International Patent Application No. PCT/KR2015/012530, dated Aug. 19, 2016, with an English translation.
European Patent Office Application Serial No. 15908859.0, Office Action dated Feb. 18, 2020, 4 pages.

* cited by examiner

RAZOR HANDLE ASSEMBLY AND RAZOR COMPRISING THE SAME

CROSS REFERENCE TO RELATED APPLICATIONS

This application is a continuation application of international application PCT/KR2015/012530, filed on Nov. 20, 2015, which claims the benefit of earlier filing date and right of priority to Korean Patent Application No. 10-2015-0163090 filed on Nov. 20, 2015, the contents of which are all hereby incorporated by reference herein in their entirety.

FIELD

The present disclosure relates to a razor handle assembly and a razor including the same, and more particularly to a razor handle assembly to which a cartridge is interchangeably coupled and a razor including the same.

BACKGROUND

Korean Patent No. 903191 discloses a conventional detachable cartridge 100, and a handle assembly 200 attachable to and detachable from the cartridge 100.

As disclosed in Korean Patent No. 903191, the conventional handle assembly 200 is assembled such that a pivot axis 230*a* formed in a holder 230 is coupled to a pivot port 221*a* of a lower housing 221.

As a result, the conventional razor has a structure in which the lower housing 221 is exposed to the outside and surrounds the holder 230, as illustrated in FIG. 12*a* of Korean Patent No. 903191.

Patent Literature

Literature 1 Korean Patent No. 903191

Since the conventional razors has a structure in which the lower housing 221 is exposed to the outside and surrounds the holder 230, and the lower housing 221 is often broken by external shock from. When the lower housing 221 is broken, the lower housing 221 cannot support the holder 230, which may cause a situation in which the cartridge 100 is not fixed and the razor cannot be used.

An object of the present disclosure is to provide a razor handle assembly and a razor including the same which are less likely to be damaged by external shock and are easy to attach and detach a cartridge.

The aspects of the present disclosure are not limited to the above-mentioned aspects, and another aspect which is not mentioned can be clearly understood by those skilled in the art from the description below.

SUMMARY

A razor handle assembly according to an embodiment of the present disclosure for solving the above-mentioned problem is a razor handle assembly to which a cartridge including a blade for cutting hair is coupled to be replaceable, the razor handle assembly including: a gripping part gripped by a user; and a connecting part provided at one end of the gripping part to fix the cartridge. The connecting part includes a cartridge holder to which the cartridge is detachably coupled, and a holder clip which supports the cartridge holder, and the cartridge holder is coupled to surround the outer side of an end portion of the holder clip.

The holder clip may include a first support rod; and a second support rod spaced apart from the first support rod by a predetermined distance and formed in parallel with the first support rod. The cartridge holder may include a fastening bar to which the cartridge is detachably coupled; a first lug formed to protrude from one side of the fastening bar and coupled to an outer side surface of the first support rod; and a second lug formed to protrude from the other side of the fastening bar and coupled to an outer side surface of the second support rod.

In order to pivotally support the cartridge holder by the holder clip, the cartridge holder may further include a first boss formed to protrude from the first lug toward the second lug, and a second boss formed to protrude from the second lug toward the first lug, and the holder clip may further include a first insertion hole formed in the first support rod to receive first boss, and a second insertion hole formed in the second support rod to receive the second boss.

In order to pivotally support the cartridge holder by the holder clip, the holder clip may further include a first boss formed to protrude from an outer side surface of the first support rod, and a second boss formed to be protrude from an outer side surface of the second support rod, and the cartridge holder may further include a first insertion hole formed in the first lug to receive the first boss, and a second insertion hole formed in the second lug to receive the second boss.

The connecting part may further include a plunger which elastically supports the fastening bar and provides a restoring force for restoring the cartridge holder to a home position.

The cartridge may include a holder receiving portion which forms a holder receiving space into which the cartridge holder is inserted, and a latch formed to protrude in the holder receiving space, and a locking claw in which the latch is received may formed in a lower part of the fastening bar.

The connecting part further may include an operation button provided to be movable back and forth within a certain region; and a pusher synchronously driven with the operation button, and the pusher is configured to elastically deform the latch received in the locking claw to disengage the latch from the locking claw, as the operation button moves in one direction.

The cartridge holder may be pivotally supported by the holder clip, the connecting part may further include a plunger which supports the fastening bar; and an elastic member interposed between the plunger and the pusher, and the elastic member may provide a first restoring force for restoring the cartridge holder to a home position by the plunger, and a second restoring force for moving the pusher and the operation button in another direction.

A razor according to an aspect for solving the aforementioned problems is a razor which includes a cartridge including a blade which cuts hair, and a razor handle assembly to which the cartridge is coupled to be replaceable, wherein the cartridge includes a holder receiving portion which forms a holder receiving space into which a part of the razor handle assembly is inserted; and a latch formed to protrude into the holder receiving space, the razor handle assembly includes a gripping part gripped by a user; and a connecting part provided at one end of the gripping part and detachably coupled to the cartridge, the connecting part includes a cartridge holder to which the cartridge is detachably coupled, and a holder clip which supports the cartridge holder, and the cartridge holder includes a locking claw which is coupled to surround an outer side of an end portion of the holder clip and formed to receive the latch.

The connecting part may further include an operation button provided to be movable back and forth within a certain region; and a pusher synchronously driven with the operation button, and the pusher is configured to elastically deform the latch received in the locking claw to disengage the latch from the locking claw, as the operation button moves in one direction.

The cartridge holder may be pivotally supported by the holder clip, the connecting part may further include a plunger which supports the cartridge holder; and an elastic member interposed between the plunger and the pusher, and the elastic member may provide a first restoring force for restoring the cartridge holder to a home position by the plunger, and a second restoring force for moving the pusher and the operation button in another direction.

The holder clip may include a first support rod; and a second support rod spaced apart from the first support rod by a predetermined distance and formed in parallel with the first support rod, and the cartridge holder may include a fastening bar in which the locking claw is formed; a first lug formed to protrude from one side of the fastening bar and coupled to an outer side surface of the first support rod; and a second lug formed to protrude from the other side of the fastening bar and coupled to an outer side surface of the second support rod.

In order to pivotally support the cartridge holder by the holder clip, the cartridge holder may further include a first boss formed to protrude from the first lug toward the second lug, and a second boss formed to protrude from the second lug toward the first lug, and the holder clip may further include a first insertion hole formed in the first support rod to receive the first boss, and a second insertion hole formed in the second support rod to receive the second boss.

In order to pivotally support the cartridge holder by the holder clip, the holder clip may further include a first boss formed to protrude from an outer side surface of the first support rod, and a second boss formed to be protrude from an outer side surface of the second support rod, and the cartridge holder may further include a first insertion hole formed in the first lug to receive the first boss, and a second insertion hole formed in the second lug to receive the second boss.

The connecting part may further include a plunger which elastically supports the fastening bar and provides a restoring force for restoring the cartridge holder to a home position.

A holder insertion port in which at least a part of the cartridge holder may be received may be formed on one side of the holder receiving portion, and an open hole expanded from the holder receiving space may be formed on the other side thereof.

Other specific matters of the present disclosure are included in the detailed description and the drawings.

According to the embodiments of the present disclosure, at least the following effects are obtained.

Since the cartridge holder coupled with the cartridge is coupled to surround the front end of the holder clip, it is possible to protect the holder clip from external shock.

Therefore, the possibility of breakage due to external shock is lowered, and the durability is improved.

Further, it is possible to more easily attach and detach the cartridge.

The effects of the present disclosure are not limited by the contents exemplified above, and various effects are further included in the present specification.

DETAILED DESCRIPTION

Figure 1:
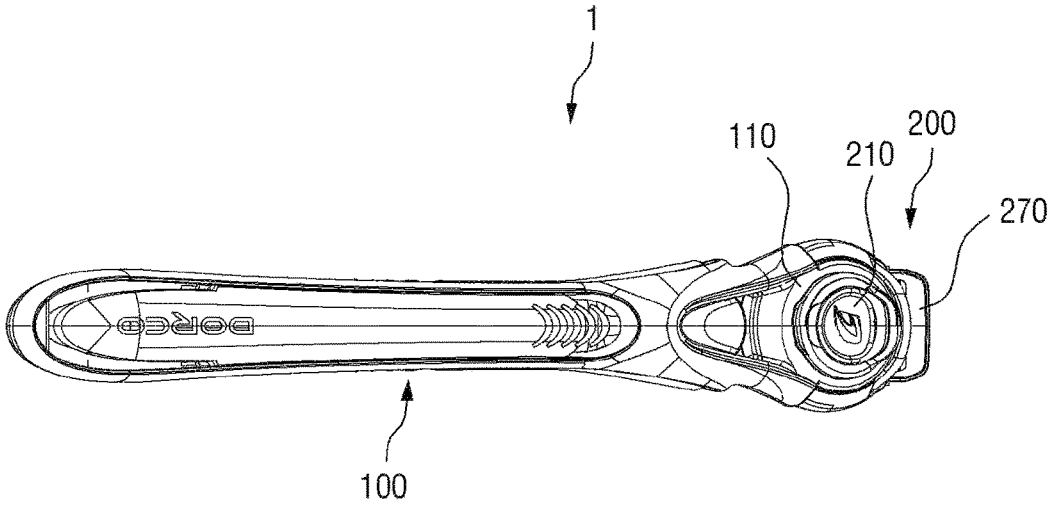
FIG. 1 is a plan view illustrating an appearance of a razor handle assembly according to an embodiment of the present disclosure.

Advantages and features of the present disclosure and methods for accomplishing the same may be understood more readily by reference to the following detailed description of preferred embodiments and the accompanying drawings. The present disclosure may, however, be embodied in many different forms and should not be construed as being limited to the embodiments set forth herein. These embodiments are simply provided so that this disclosure is thorough and complete and fully conveys the concept of the disclosure to those skilled in the art, and the present disclosure will only be defined by the appended claims. The same reference numerals refer to the same elements throughout the specification.

Furthermore, the embodiments described herein will be described with reference to a cross-sectional view and/or a schematic view, which is an ideal diagram of the present disclosure. Therefore, the form of the diagram may be modified by manufacturing technique and/or tolerance. Also, in each drawing illustrated in the present disclosure, each constituent element may have been illustrated to be slightly enlarged or reduced in view of the convenience of explanation. The same reference numerals refer to the same elements throughout the specification.

Hereinafter, the present disclosure will be described with reference to the drawings for explaining a razor handle assembly and a razor including the same according to an embodiment of the present disclosure.

FIG. 1 is a plan view illustrating an appearance of a razor handle assembly according to an embodiment of the present disclosure.

As illustrated in FIG. 1, a razor handle assembly 1 according to an embodiment of the present disclosure includes a gripping part 100 and a connecting part 200.

The gripping part 100 is a part which is grasped by the user's hand while the razor is being used, and the connecting part 200 is a part to which a replacement type cartridge (2, see FIG. 3) is attached.

A housing 110 for supporting the connecting part 200 is provided at one end of the gripping part 100. As illustrated in FIG. 1, the connecting part 200 is received in the housing 110 such that an operation button 210 and a cartridge holder 270 are exposed to the outside of the housing 110.

The cartridge holder 270 is configured to be inserted into the cartridge 2 and coupled with the cartridge 2, and the operation button 210 is configured to serve as a switch for separating the cartridge 2 from the gripping part 100.

Hereinafter, the connecting part 200 of the razor handle assembly 1 according to an embodiment of the present disclosure will be described more specifically.

Figure 2:
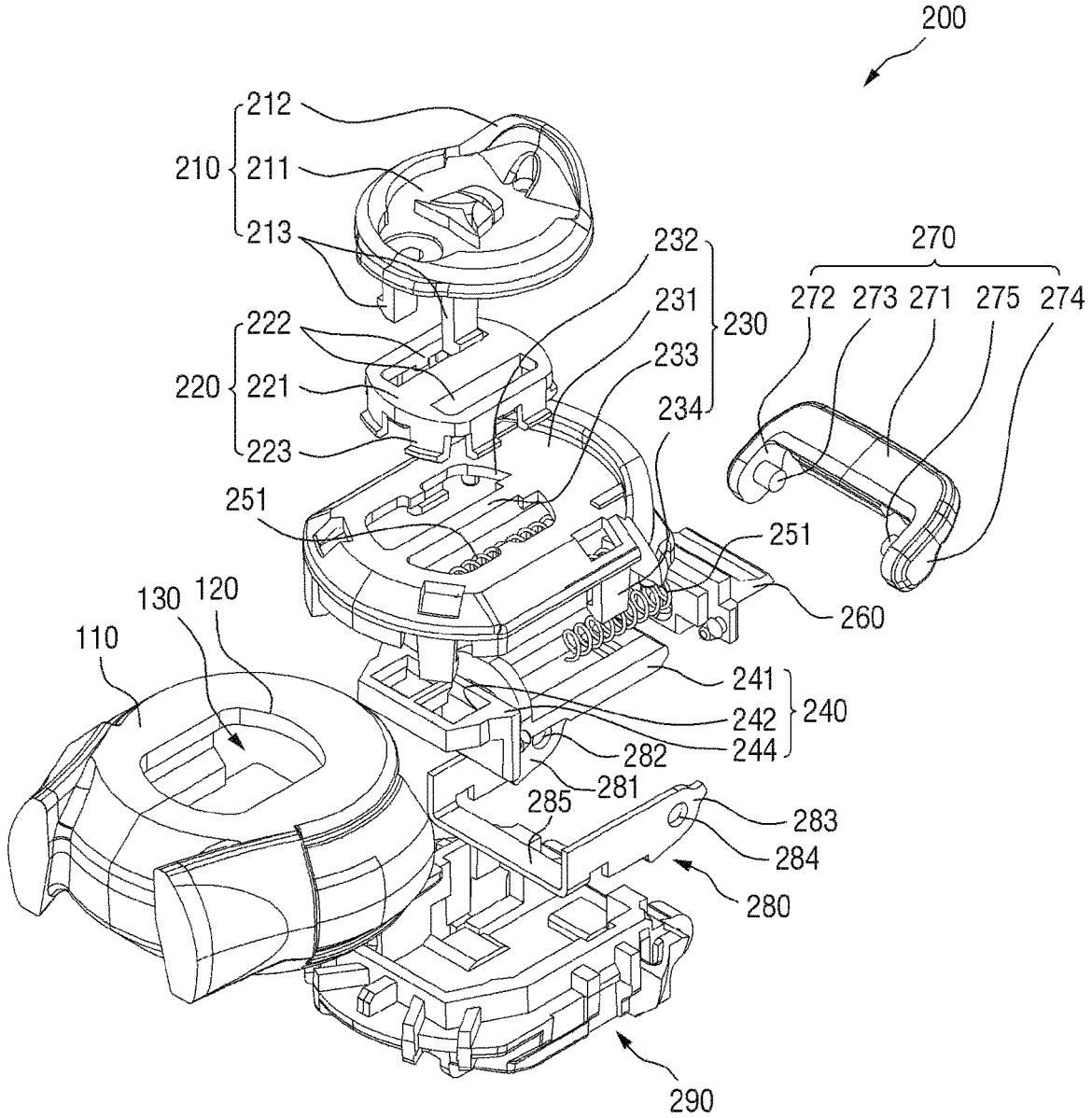
FIG. 2 is an exploded perspective view of an end portion of a gripping part of the razor handle assembly and a connecting part according to an embodiment of the present disclosure.

FIG. 2 is an exploded perspective view of an end portion of the gripping part of the razor handle assembly and the connecting part according to an embodiment of the present disclosure.

As illustrated in FIG. 2, the housing 110 formed at the end portion of the gripping part 100 includes an open type installation space 130 through which an upper case 230, a lower case 290 and the like of the connecting part 200 can be inserted from one end and installed. A block installing through-hole 120 to which the operation button support block 220 is coupled is formed on the upper surface of the housing 110.

On the other hand, the connecting part 200 includes the operation button 210, an operation button support block 220, the upper case 230, a pusher 240, an elastic member 251, a plunger 260, a cartridge holder 270, a holder clip 280 and the lower case 290.

As illustrated in FIG. 2, the operation button 210 includes a base plate 211, a protruding end 212, and a first hook end 213.

The operation button 210 is a button used when the user intends to separate the cartridge (2, see FIG. 3) from the razor handle assembly 1, and the user can separate the cartridge 2 by pushing the operation button 210 toward the cartridge 2, while pressing the base plate 211.

Generally, since the user uses the operation button 210 while pressing the base plate 211 using the thumb, the base plate 211 may have a circular shape approximately corresponding to an area of a first node of the thumb. However, the shape of the base plate 211 may be variously modified depending on a design, an ease of use, and the like.

The protruding end 212 is formed to protrude from the front end of the upper surface of the base plate 211. The protruding end 212 supports the user's fingertip which moves the operation button 210 while pressing the base plate 211 so that the user can more easily move the operation button 210.

The first hook end 213 is formed to protrude from the lower surface of the base plate 211. The first hook end 213 is inserted into a first hook end coupling hole 244 of a pusher 240 to be described later to fix the operation button 210 to the pusher 240. The operation button 210 is hooked to the pusher 240 with the operation button support block 220, the upper surface of the housing 110 and the upper case 230 interposed therebetween.

The operation button support block 220 includes a block body 221 and a second hook end 223.

The base plate 211 of the operation button 210 is seated on the upper surface of the block body 221. As illustrated in FIG. 2, a slot 222 through which the first hook end 213 of the operation button 210 passes is formed to penetrate the block body 221. The slot 222 is formed to extend by a certain length in one direction so that the first hook end 213 can move along the slot 222, thereby guiding the movement distance and the direction of the operation button 210.

On the other hand, the second hook end 223 is formed to protrude downward from the block body 221. The second hook end 223 is inserted into a second hook end coupling hole 232 of the upper case 230 to fix the operation button support block 220 to the upper case 230. Therefore, when the operation button 210 moves forward and backward, the operation button support block 220 maintains a fixed state.

As illustrated in FIG. 2, the upper case 230 includes an upper case body 231 and a third hook end 234.

A second hook end coupling hole 232 into which the second hook end 223 of the operation button support block 220 is inserted is formed in the upper case body 231. In the second hook end coupling hole 232, a support bar 233 passing through the center of the second hook end coupling hole 232 is formed.

The support bar 233 supports a part of the lower end of the block body 221 so that the operation button support block 220 does not pass through the second hook end coupling hole 232 but is positioned on the upper surface of the upper case body 231. Therefore, the operation button support block 220 may be fixed to the upper case 230 by the second hook end 223, while being supported by the support bar 233.

The third hook end 234 is formed to protrude downward from the outside of the upper case body 231. The third hook end 234 is coupled to the outside of the lower case 290 to couple the upper case 230 and the lower case 290.

The upper case 230 and the lower case 290 form a space in which a pusher 240, an elastic member 251, a plunger 260 and a holder clip 280 to be described later can be installed in the coupled state.

On the other hand, the pusher 240 is installed between the upper case 230 and the lower case 290 so as to be slidable in the front-rear direction. As illustrated in FIG. 2, the pusher 240 includes a push arm 241, a support wall 242, and a first hook end coupling hole 244.

The push arm 241 is formed to extend from the support wall 242 toward the front (in the direction of the cartridge 2). The first hook end coupling hole 244 is formed to pass through a plate extending from the support wall 242 toward the rear (in the direction of the gripping part 100).

As described above, the first hook end 213 of the operation button 210 is inserted in the first hook end coupling hole 244. Therefore, the pusher 240 is synchronously driven with the operation button 210. That is, as the operation button 210 moves forward and backward, the pusher 240 moves integrally with the operation button 210.

On the other hand, the plunger 260 is installed between the upper case 230 and the lower case 290 so as to be positioned on the upper portion of the push arm 241. The elastic member 251 is interposed between the support wall 242 of the push arm 241 and the plunger 260 so that the pusher 240 and the plunger 260 are elastically supported.

A coupling protrusion (245, see FIG. 5), to which one end of the elastic member 251 is fixedly installed, is formed on the support wall 242. A coupling protrusion to which the other end of the elastic member 251 is fixedly installed may be formed at the rear end of the plunger 260.

The plunger 260 is installed in the upper part of the push arm 241 so as to be slidable in the front-rear direction, is elastically supported by the elastic member 251, is retracted by an external force, and moves forward again when the external force is removed. The plunger 260 elastically supports a fastening bar 271 of a cartridge holder 270 to be described later, by utilizing the elastic force of the elastic member 251.

Further, the pusher 240 moves forward by the forward movement force of the operation button 210, and when the external force is removed, the pusher 240 is retracted again by the elastic force of the elastic member 251.

On the other hand, the holder clip 280 is fixed to the lower case 290 so as to be located between the pusher 240 and the lower case 290.

As illustrated in FIG. 2, the holder clip 280 includes a first support rod 281, a second support rod 283, and a load connection bar 285.

The first support rod 281 is formed to protrude forward from one side of the rod connection bar 285 by a certain distance, and the second support rod 283 is formed to protrude forward from the other side of the rod connection bar 285 by a certain distance. The first support rod 281 and the second support rod 283 are formed side by side so as to be spaced apart from each other by a predetermined distance.

A first insertion hole 282 is formed in the first support rod 281, and a second insertion hole 284 is formed in the second support rod 283.

As illustrated in FIG. 2, the cartridge holder 270 includes a fastening bar 271, a first lug 272 and a second lug 274.

The first lug 272 is formed to protrude from one side of the fastening bar 271, and the second lug 274 is formed to protrude from the other side of the fastening bar 271. The first lug 272 is provided with a first boss 273 formed to protrude toward the second lug 274, and the second lug 274 is provided with a second boss 275 formed to protrude toward the first lug 272.

The fastening bar 271 may be formed to be horizontally longer than the load connection bar 285 of the holder clip 280 so that the cartridge holder 270 is coupled to surround the outer side of the end portion of the holder clip 280.

The first lug 272 comes into contact with the outer surface (the surface opposite to the surface facing the second support rod 283) of the first support rod 281 of the holder clip 280, and the first boss 273 is installed so as to be inserted into the first insertion hole 282 of the first support rod 281.

The second lug 274 comes into contact with the outer surface (the surface opposite the surface facing the first support rod 281) of the second support rod 283 of the holder clip 280, and the second boss 275 is installed so as to be inserted into the second insertion hole 284 of the second support rod 283.

Therefore, the cartridge holder 270 is pivotally supported by the holder clip 280. Also, since the cartridge holder 270 is coupled to surround the front end of the holder clip 280, the cartridge holder 270 can protect the holder clip 280 from external shock and the like.

As another embodiment, unlike the configuration illustrated in FIG. 2, a first insertion hole 282 instead of the first boss 273 is formed in the first lug 272, a second insertion hole 284 instead of the second boss 275 is formed in the second lug 274, a first boss 273 instead of the first insertion hole 282 is formed in the first support rod 281, a second boss 275 instead of the second insertion hole 284 is formed in the second support rod 283, and the cartridge holder 270 may be pivotally supported by the holder clip 280.

Figure 3:
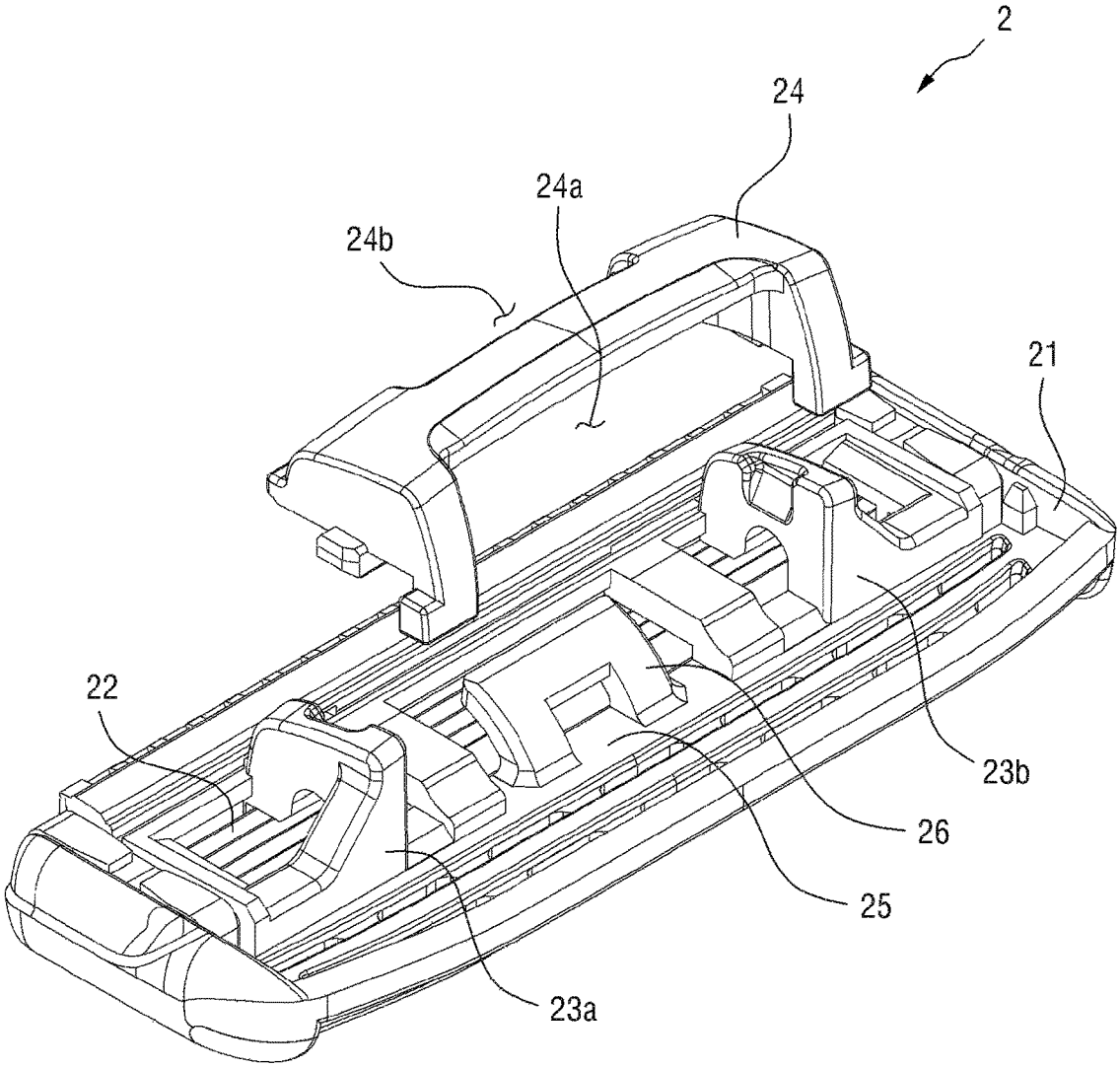
FIG. 3 is an exploded perspective view of a cartridge that is interchangeably-coupled to the razor handle assembly according to an embodiment of the present disclosure.

On the other hand, FIG. 3 is an exploded perspective view of a cartridge that is interchangeably coupled to the razor handle assembly according to an embodiment of the present disclosure.

As illustrated in FIG. 3, a cartridge 2 interchangeably coupled to the razor handle assembly 1 according to an embodiment of the present disclosure includes a plurality of blades 22 for cutting hair, and a cartridge frame 21 for supporting a plurality of blades 22.

As illustrated in FIG. 3, the cartridge frame 21 has a roughly rectangular framework opened front and rear. Specifically, the cartridge frame 21 includes a pair of vertical frames (not illustrated) formed on each of left and right sides, and a pair of horizontal frames which connects the pair of side frames. The plurality of blades 22 is installed such that the cutting edge is exposed on the front surface of the cartridge frame 21 in a state in which both ends are supported by the side frames.

As illustrated in FIG. 3, one of the horizontal frames 25 of the cartridge frame 21 is provided with a latch 26 protruding toward the rear part of the cartridge 2.

The latch 26 is formed to extend from the central portion of the horizontal frame 25 toward the open hole **24*b* of the holder receiving portion 24. The latch 26 can be formed to have an arc shape protruding to the rear part of the cartridge 2, and has a structure in which the other end is elastically deformed by an external force while being supported by the horizontal frame 25** at one end.

Further, jig protrusions **23*a* and 23*b* coupled to the holder receiving portion 24 are formed to protrude from both sides of the latch 26**.

Although FIG. 3 illustrates an example in which the latch 26 is formed in the horizontal frame 25, according to the embodiment, the cartridge 2 has another support frame formed between the horizontal frames, and the latch 26 may be formed to protrude rearward from the support frame. In this case, the support frame may be formed substantially parallel to the horizontal frame.

The holder receiving portion 24 is a member which forms a holder receiving space (not illustrated) in which the cartridge holder 270 is received. A coupling structure for being coupled to the jig protrusions **23*a* and 23*b* is formed on both sides of the holder receiving portion 24, an open hole 24*b* is formed in the upper part thereof, and a holder insertion port 24*a* into which the cartridge holder 270 is inserted is formed in the lower part thereof. The open hole 24*b* and the holder insertion port 24*a*** may be spaces expanded from the holder receiving space.

The cartridge 2 according to the present embodiment is configured in which the holder receiving portion 24 and the cartridge frame 21 are separated from each other. Therefore, even when an external shock within a certain range is applied to the cartridge 2, the holder receiving portion 24 may be deformed separately from the cartridge frame 21 and may absorb the external shock.

Therefore, compared with the case where the holder receiving portion 24 is integrally formed with the cartridge frame 21, the possibility of breakage due to external shock is reduced. In addition, when an external shock of a certain level or more is applied, since the holder receiving portion 24 may be separated from the cartridge frame 21, the possibility of breakage due to external shock is reduced as compared with the case where the holder receiving portion 24 is formed integrally with the cartridge frame 21.

Since the holder receiving portion 24 of the cartridge 2 according to the present embodiment has a separate opening hole **24*b* formed in addition to the holder insertion port 24*a*, the holder receiving portion 24** can be more easily elastically deformed.

For convenience of explanation, the cartridge 2 illustrated in FIG. 3 illustrates only an example of a cartridge coupled to the razor handle assembly 1 according to an embodiment of the present disclosure, and the razor handle assembly 1 according to an embodiment of the present disclosure may be coupled with more various forms of cartridges.

Figure 4:
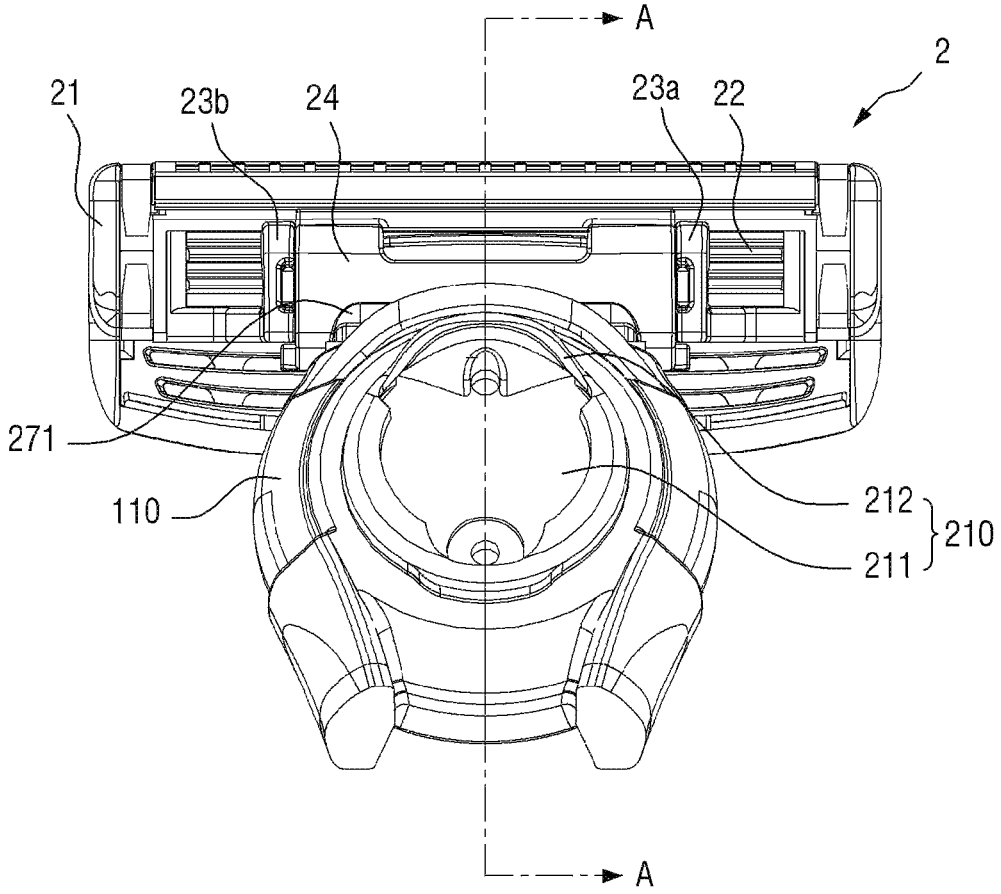
FIG. 4 is a plan view illustrating a state in which the cartridge is coupled to the razor handle assembly according to an embodiment of the present disclosure.
Figure 5:
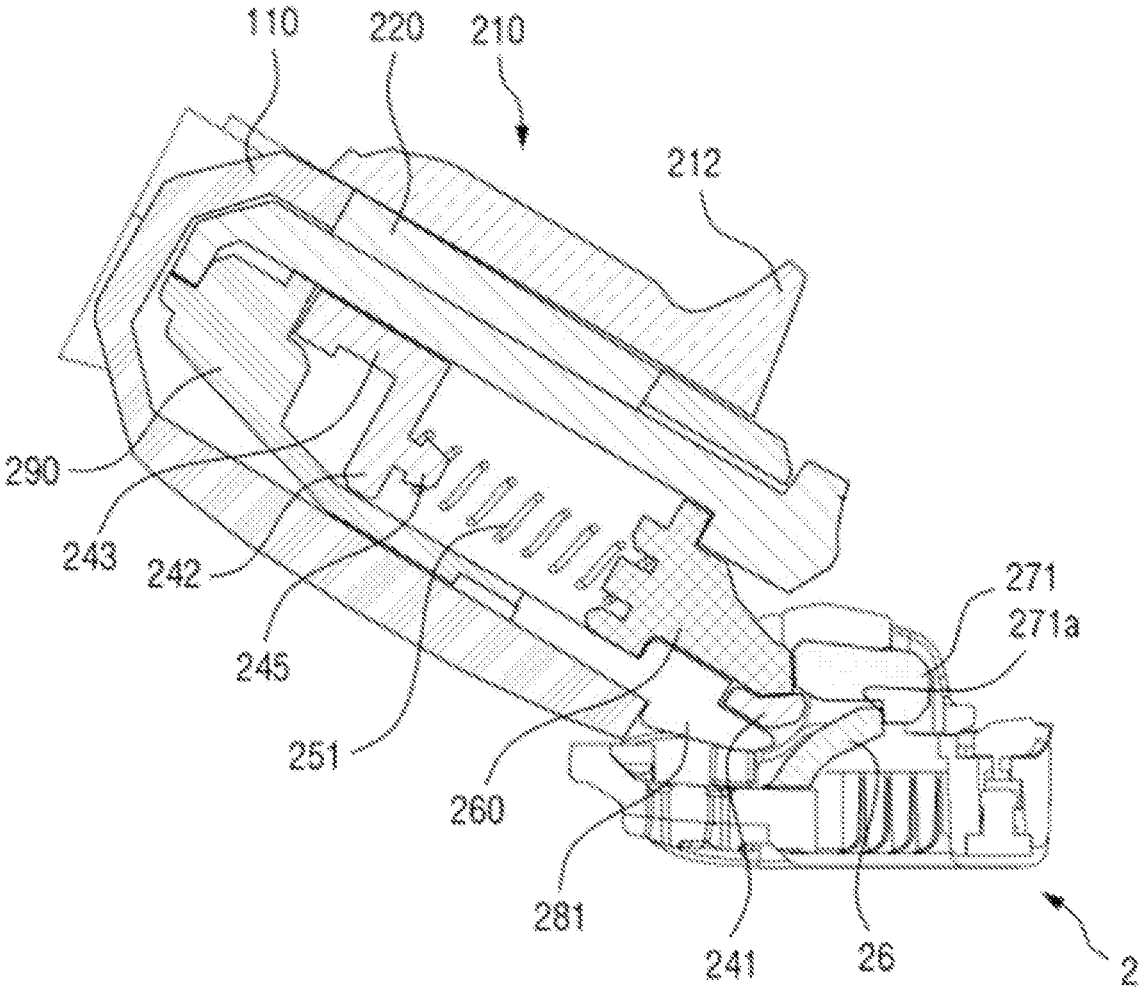
FIG. 5 is a schematic cross-sectional view taken along line AA of FIG. 4.

FIG. 4 is a plan view illustrating a state in which the cartridge is coupled to the razor handle assembly according to an embodiment of the present disclosure, and FIG. 5 is a schematic cross-sectional view taken along line AA of FIG. 4.

As illustrated in FIGS. 4 and 5, in the razor handle assembly 1 according to an embodiment of the present disclosure, the cartridge holder 270 is inserted into the holder receiving portion 24 of the cartridge 2 and is coupled with the cartridge 2.

As illustrated in FIG. 5, a locking claw 271*a* in which the latch 26 is received is formed in a lower part of a fastening bar 271 of the cartridge holder 270.

Since the other end of the latch 26 is elastically deformed by an external force, the end portion is pushed downward by the fastening bar 271 and elastically deformed during entry of the cartridge holder 270 into the holder receiving space of the cartridge 2. After that, the end portion passes through the locking claw 271*a*, and at the same time, the end portion is lifted upward and is engaged with the locking claw 271*a*. As a result, the cartridge holder 270 is fixed in the cartridge 2, and the cartridge 2 is coupled to the razor handle assembly 1.

Since the razor according to the embodiment of the present disclosure has the cartridge coupling structure of the latch 26 and the locking claw 271*a*, the razor can couple the cartridge 2 to the razor handle assembly 1 with the simplified cartridge coupling structure as compared to the conventional razor.

The plunger 260 and the support wall 242 of the pusher 240 are mutually elastically supported by the elastic member 251. The plunger 260 elastically supports the fastening bar 271 by utilizing the elastic force of the elastic member 251. The position at which the plunger 260 is located in a state in which no external force is applied may be at a home position of the plunger. In this state, the position of the cartridge holder 270 supported by the plunger 260 may be a home position of the cartridge holder.

The pusher 240 may be maximally retracted backward in the space in the upper case 230 and the lower case 290 by the elastic force of the elastic member 251. The position at which the pusher 240 is located in the state in which no external force is applied may be a home position of the pusher, and the position of the operation button 210 when the pusher 240 is at the home position may be a home position of the operation button.

FIG. 5 illustrates a state in which no external force is applied after the cartridge 2 is coupled to the razor handle assembly 1. The pusher 240, the operation button 210, the plunger 260, and the cartridge holder 270 are located at the home positions.

Figure 6:
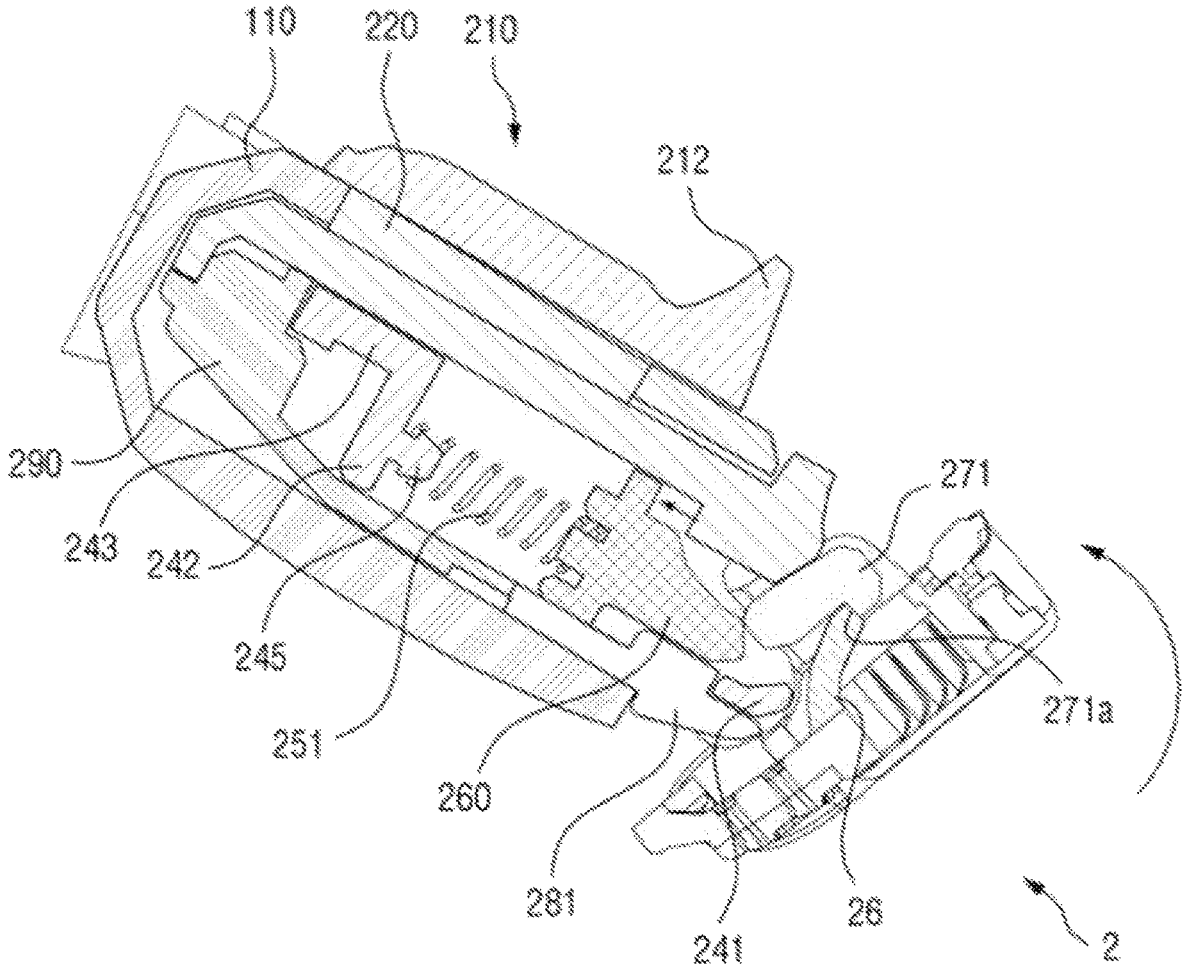
FIG. 6 is a schematic cross-sectional view illustrating a driving state of the cartridge holder and the plunger according to the rotation of the cartridge.

FIG. 6 is a schematic cross-sectional view illustrating the driving state of the cartridge holder and the plunger according to pivoting of the cartridge.

As illustrated in FIG. 6, in a process in which a user uses a razor in which the cartridge 2 is coupled to the razor handle assembly 1, the cartridge 2 may be used while pivoting about the razor handle assembly 1 by external force.

As the cartridge 2 pivots about the razor handle assembly 1, the cartridge holder 270 fixed to the cartridge 2 also pivots integrally with the cartridge 2. Further, the plunger 260 is retracted backward with pivoting of the cartridge holder 270, and elastically supports the cartridge holder 270. The retraction distance of the plunger 260 may vary depending on a shape of a part in which the plunger 260 and the fastening bar 271 make contact with each other, and a pivoting angle of the cartridge 2.

Thereafter, when the external force which pivots the cartridge 2 to the state illustrated in FIG. 6 is removed, the plunger 260 moves forward again due to the elastic force of the elastic member 251, and restores the cartridge holder 270 to the home position (the state of FIG. 5). That is, the elastic force of the elastic member 251 is used as a restoring force (first restoring force) by which the plunger 260 restores the cartridge holder 270 to the home position.

Figure 7:
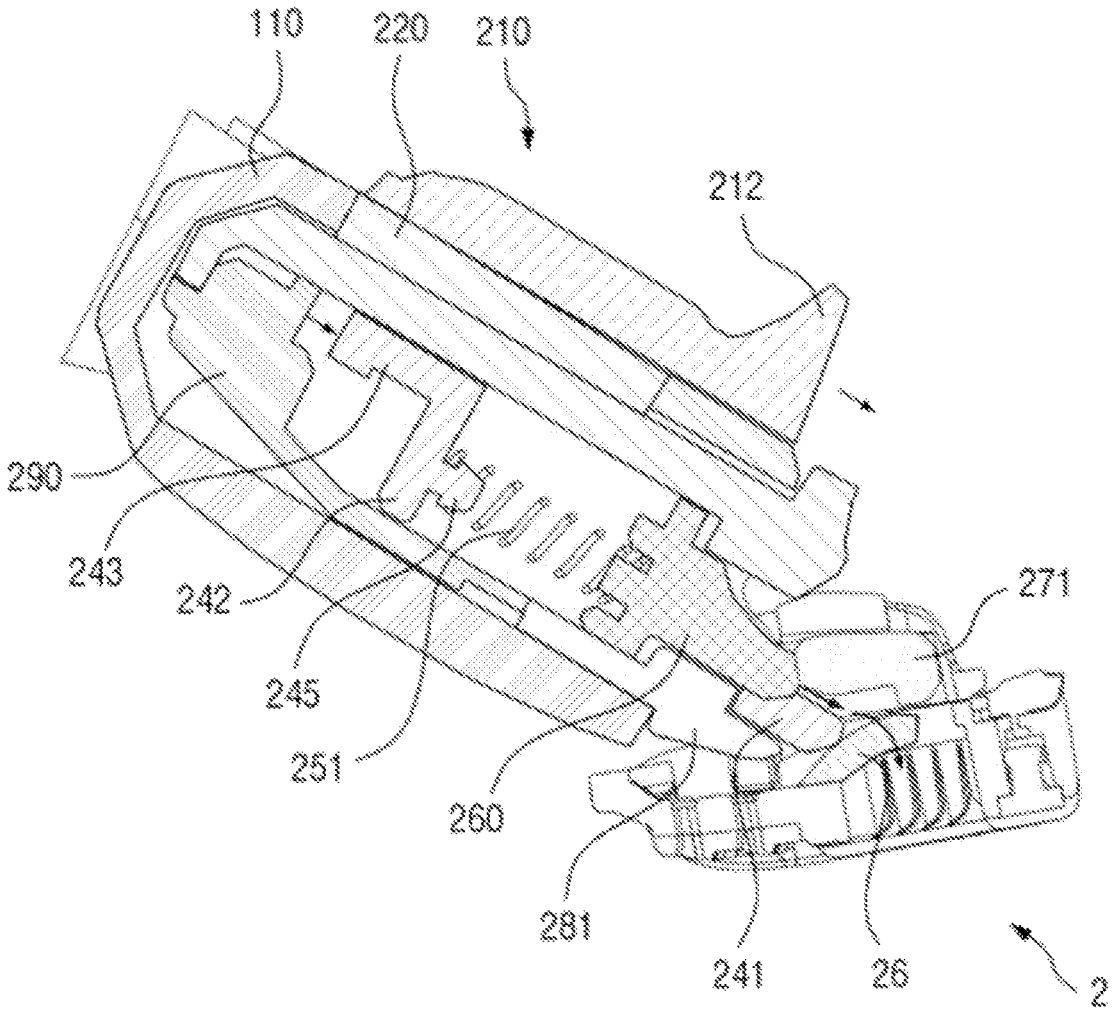
FIG. 7 is a schematic diagram illustrating a driving state of an operation button and a pusher for cartridge separation.

FIG. 7 is a schematic diagram illustrating the driving state of the operation button and the pusher for cartridge separation.

As illustrated in FIG. 7, when intending to separate the cartridge 2 from the razor handle assembly 1, the operation button 210 may be moved forward (in the direction of the cartridge) by a predetermined distance to separate the cartridge 2 from the razor handle assembly 1.

Specifically, as the user moves the operation button 210 forward by a predetermined distance, the pusher 240 moves forward together with the operation button 210.

As the pusher 240 moves forward, the push arm 241 moves forward to elastically deform the latch 26 and disengage the latch 26 from the locking claw 271*a*.

As the latch 26 is disengaged from the locking claw 271*a*, the cartridge holder 270 may enter a state of being detachable from the cartridge 2 to separate the cartridge 2 from the razor handle assembly 1.

Thereafter, when the external force of moving the operation button 210 forward is removed, the pusher 240 moves backward again due to the elastic force of the elastic member 251 and moves the operation button 210 to a home position (the state illustrated in FIG. 5). That is, the elastic force of the elastic member 251 is used as a restoring force (second restoring force) for restoring the pusher 240 and the operation button 210 to the home position.

Since the razor according to the embodiment of the present disclosure can separate the cartridge 2 from the razor handle assembly 1, simply by elastically deforming the latch 26, using the pusher 240, the force required to separate the cartridge is smaller than the conventional razor, and it is easy to remove the cartridge.

Those having ordinary skill in the technical field to which the present disclosure belongs will appreciate that the present disclosure does not change its technical idea and essential features and may be implemented in other specific forms. It is therefore to be understood that the above-described embodiments are illustrative in all aspects and not restrictive. It is to be understood that the scope of the present disclosure is defined by the claims rather than the above detailed description, and all changes or modifications deduced from the meaning and range of the following claims and their equivalents should be interpreted as being within the scope of the present disclosure.

A razor handle assembly according to an embodiment of the present disclosure is a razor handle assembly to which a cartridge including a blade for cutting hair is coupled to be replaceable, wherein the razor handle assembly includes a gripping part gripped by a user; and a connecting part provided at one end of the gripping part to fix the cartridge, the connecting part includes a cartridge holder to which the cartridge is detachably coupled, and a holder clip which supports the cartridge holder, and the cartridge holder is coupled to surround the outer side of the end portion of the holder clip.

A razor according to an embodiment of the present disclosure is a razor which includes a cartridge including a blade which cuts hair, and a razor handle assembly to which the cartridge is coupled to be replaceable, wherein the cartridge includes a holder receiving portion which forms a holder receiving space into which a part of the razor handle assembly is inserted; and a latch formed to protrude into the holder receiving space, wherein the razor handle assembly includes a gripping part gripped by a user, and a connecting part provided at one end of the gripping part and detachably coupled to the cartridge, wherein the connecting part includes a cartridge holder to which the cartridge is detachably coupled, and a holder clip which supports the cartridge holder, and the cartridge holder includes a locking claw which is coupled to surround the outer side of the end portion of the holder clip and is formed to receive the latch.

What is claimed is:

1. A razor handle assembly comprising:

a gripping part gripped by a user; and a connecting part provided at one end of the gripping part to receive a replaceable cartridge including a blade for cutting hair, wherein the connecting part comprises:

a cartridge holder to which the cartridge is detachably coupled; and a holder clip comprising:

a first support rod comprising a first end portion of the holder clip; and a second support rod comprising a second end portion of the holder clip, and wherein the cartridge holder is coupled to the holder clip such that an inner side of a first end portion of the cartridge holder contacts an outer side of the first end portion of the holder clip and an inner side of a second end portion of the cartridge holder contacts an outer side of the second end portion of the holder clip.

2. The razor handle assembly of claim 1, wherein the holder clip further comprises a rod connection bar such that:

the first support rod is formed to protrude from one side of the rod connection bar; and the second support rod is formed to protrude from another side of the rod connection bar such that the second support rod is spaced apart from the first support rod by a predetermined distance and formed in parallel with the first support rod, and wherein the cartridge holder comprises:

a fastening bar to which the cartridge is detachably coupled;

a first lug including the first end portion of the cartridge holder and formed to protrude from one side of the fastening bar and coupled to the outer side of the first end portion of the holder clip; and a second lug including the second end portion of the cartridge holder and formed to protrude from another side of the fastening bar and coupled to the outer side of the second end portion of the holder clip.

3. The razor handle assembly of claim 2, wherein the cartridge coupled to the razor handle assembly comprises:

a holder receiving portion configured to receive the cartridge holder; and a latch formed to protrude into the holder receiving portion, and wherein a locking claw is formed in a lower part of the fastening bar to receive the latch.

4. The razor handle assembly of claim 3, wherein the connecting part further comprises:

an operation button provided to be movable back and forth within a certain region; and a pusher synchronously driven with the operation button, and wherein the pusher is configured to elastically deform the latch received in the locking claw to disengage the latch from the locking claw, as the operation button moves in one direction.

5. The razor handle assembly of claim 4, wherein the cartridge holder is pivotally supported by the holder clip, and the connecting part further comprises:

a plunger which supports the fastening bar; and an elastic member interposed between the plunger and the pusher, and wherein the elastic member provides a first restoring force for restoring the cartridge holder to a home position by the plunger, and a second restoring force for moving the pusher and the operation button in another direction.

6. The razor handle assembly of claim 2, wherein in order to pivotally support the cartridge holder by the holder clip, the cartridge holder further comprises a first boss formed to protrude from the first lug toward the second lug, and a second boss formed to protrude from the second lug toward the first lug, and the holder clip further comprises a first insertion hole formed in the first support rod to receive the first boss, and a second insertion hole formed in the second support rod to receive the second boss.

7. The razor handle assembly of claim 2, wherein in order to pivotally support the cartridge holder by the holder clip, the holder clip further comprises:

a first boss formed to protrude from an outer side surface of the first support rod, and a second boss formed to protrude from an outer side surface of the second support rod, and wherein the cartridge holder further comprises:

a first insertion hole formed in the first lug to receive the first boss, and a second insertion hole formed in the second lug to receive the second boss.

8. The razor handle assembly of claim 6, wherein the connecting part further comprises a plunger which elastically supports the fastening bar and provides a restoring force for restoring the cartridge holder to a home position.

9. The razor handle assembly of claim 7, wherein the connecting part further comprises a plunger which elastically supports the fastening bar and provides a restoring force for restoring the cartridge holder to a home position.

10. A razor comprising:

a cartridge including a blade which cuts hair; and a razor handle assembly comprising:

a gripping part gripped by a user; and a connecting part provided at one end of the gripping part, wherein the cartridge comprises:

a holder receiving portion; and a latch formed to protrude into the holder receiving portion, wherein the connecting part of the razor handle assembly comprises:

a cartridge holder; and a holder clip comprising:

a first support rod comprising a first end portion of the holder clip; and a second support rod comprising a second end portion of the holder clip, and wherein:

the cartridge holder is coupled to the holder clip such that an inner side of a first end portion of the cartridge holder contacts an outer side of the first end portion of the holder clip and an inner side of a second end portion of the cartridge holder contacts an outer side of the second end portion of the holder clip; and the cartridge holder comprises a locking claw configured to receive the latch of the cartridge when the cartridge holder is received in the holder receiving portion of the cartridge, such that the cartridge is detachably coupled to the razor handle assembly.

11. The razor of claim 10, wherein the connecting part further comprises:

an operation button provided to be movable back and forth within a certain region; and a pusher synchronously driven with the operation button, and wherein the pusher is configured to elastically deform the latch received in the locking claw to disengage the latch from the locking claw, as the operation button moves in one direction.

12. The razor of claim 11, wherein the cartridge holder is pivotally supported by the holder clip, and the connecting part further comprises:

a plunger which supports the cartridge holder; and an elastic member interposed between the plunger and the pusher, and wherein the elastic member provides a first restoring force for restoring the cartridge holder to a home position by the plunger, and a second restoring force for moving the pusher and the operation button in another direction.

13. The razor of claim 10, wherein the holder clip further comprises a rod connection bar such that:

the first support rod is formed to protrude from one side of the rod connection bar; and the second support rod is formed to protrude from another side of the rod connection bar such that the second support rod is spaced apart from the first support rod by a predetermined distance and formed in parallel with the first support rod, and wherein the cartridge holder comprises:

a fastening bar in which the locking claw is formed;

a first lug including the first end portion of the cartridge holder and formed to protrude from one side of the fastening bar and coupled to the outer side of the first end portion of the holder clip; and a second lug including the second end portion of the cartridge holder and formed to protrude from another side of the fastening bar and coupled to the outer side of the second end portion of the holder clip.

14. The razor of claim 10, wherein:

the holder receiving portion comprises a holder insertion port formed on one side of the holder receiving portion and an open hole formed on the other side of the holder receiving portion; and the cartridge holder is inserted into the holder receiving portion through the holder insertion port.

* * * * *